United States Patent [19]

Friesen et al.

[11] 4,397,221

[45] Aug. 9, 1983

[54] REGENERATIVE VALVE

[75] Inventors: Henry Friesen, Niagara Falls; John Rosbak, Fonthill, both of Canada

[73] Assignee: Deere & Company, Moline, Ill.

[21] Appl. No.: 269,110

[22] Filed: Jun. 1, 1981

[51] Int. Cl.[3] ..... F15B 13/042

[52] U.S. Cl. ..... 91/420; 91/436; 137/106

[58] Field of Search ..... 91/420, 436, 433, 437, 91/439; 137/106

[56] References Cited

U.S. PATENT DOCUMENTS

| | | | |
|---|---|---|---|
| 1,812,587 | 6/1931 | Ellis . | |
| 2,267,284 | 12/1941 | Livers . | |
| 2,367,682 | 1/1945 | Kehle . | |
| 2,376,519 | 5/1945 | Stacy . | |
| 2,379,180 | 6/1945 | Pohl . | |
| 2,590,454 | 3/1952 | Pilch . | |
| 2,628,731 | 2/1953 | Reuter . | |
| 2,646,025 | 7/1953 | Deardorff . | |
| 2,694,384 | 11/1954 | Evans . | |
| 2,890,683 | 6/1959 | Pilch . | |
| 3,234,957 | 2/1966 | Allen | 137/117 |
| 3,237,636 | 3/1966 | Strader | 137/115 |
| 3,267,961 | 8/1966 | Rice | 137/596 |
| 3,319,653 | 5/1967 | Stephens | 137/596 |
| 3,335,739 | 8/1967 | Rice | 137/115 |
| 3,448,685 | 6/1969 | Kroth | 91/436 |
| 3,465,788 | 9/1969 | Tennis | 137/596 |
| 3,474,708 | 10/1969 | Schmiel | 91/436 |
| 3,474,824 | 10/1969 | Roy et al. | 137/596.13 |
| 3,497,032 | 2/1970 | Schott . | |
| 3,568,707 | 3/1971 | Shore | 137/117 |
| 3,654,835 | 4/1972 | Sievenpiper | 91/436 |
| 3,795,177 | 3/1974 | Cryder et al. | 91/436 |
| 4,144,947 | 3/1979 | Withers et al. | 91/436 |
| 4,194,436 | 3/1980 | Imada | 91/420 |
| 4,216,702 | 8/1980 | Brundidge et al. | 91/436 |

FOREIGN PATENT DOCUMENTS

| | | |
|---|---|---|
| 3032596 | 12/1981 | Fed. Rep. of Germany . |
| 863701 | of 1959 | United Kingdom . |
| 141046 | of 1961 | U.S.S.R. . |

*Primary Examiner*—Martin P. Schwadron
*Assistant Examiner*—Richard L. Klein

[57] ABSTRACT

A regenerative valve includes a housing having a valve bore therein intersecting with an extension passage interconnecting a pump and a piston extension chamber, a retraction passage interconnecting a sump and a piston retraction chamber, and a regenerative passage for communicating fluid from the retraction to the extension chamber upon extension of the piston. A poppet member is movable in the bore to open and block fluid flow through the extension passage. A shuttle member is movable in the bore to either open or block one or the other of the regenerative and retraction passages. The shuttle member engages the poppet to cause the poppet to open the extension passage when the shuttle moves to close the retraction passage and open the regenerative passage.

14 Claims, 3 Drawing Figures

REGENERATIVE VALVE

BACKGROUND OF THE INVENTION

The present invention relates to a regenerative or speed-up valve which operates to enhance or speed up the extension of a reciprocating cylinder.

Many valve arrangements for speeding up the extension of a double-acting cylinder are known in the prior art. One type of such speed-up valve includes a single shuttle or spool member which is movable within a ported valve housing. This type of speed-up valve is described in U.S. Pat. Nos. 2,890,683; 2,590,454; and 1,812,587. However, the single shuttle type valve is subject to a failure condition wherein a rapid pressure buildup in the rod end of the cylinder (due to heavy loads on the cylinder) may prevent or delay the shuttle from shifting to the regenerative or speed-up mode wherein fluid is recirculated from the rod to the head end of the cylinder. In order to solve this problem, more complex or compound speed-up valves have been proposed which utilize a combination of separate check and shuttle valves. Such compound speed-up valves are disclosed in U.S. Pat. Nos. 4,194,436; 4,144,947; 3,654,835 and 3,568,707, for example. However, such compound speed-up valves have been costly, complex and bulky due to the physical arrangements of the separate shuttle and check valve elements.

SUMMARY OF THE INVENTION

An advantage of the present invention is that it provides a speed-up valve of simple and compact design.

Another advantage of the present invention is that it provides a speed-up valve which is not subject to pressure locks during extension of cylinders with heavy loading.

These and other advantages are achieved by the present invention which provides a speed-up valve with a housing having a valve bore therein, an extension passage for connecting a pressure source to a cylinder extension chamber, a retraction passage for connecting a fluid reservoir with the cylinder retraction chamber and a regeneration passage for interconnecting the cylinder retraction and extension chamber. These passages all intersect the valve bore. A directional control valve can reverse the connections between the source and reservoir and the extension and retraction chambers so that the cylinder may be extended or retracted. A poppet spring urges a poppet valve member, which moves in the bore, into sealing engagement with a seat in the extension passage to prevent fluid flow from the source to the extension chamber. A shuttle spring urges a hollow cylindrical shuttle valve member movable in the bore to a normal position blocking the regeneration passage and opening the retraction passage. The shuttle is movable to a regeneration position blocking the retraction passage and opening the regeneration passage. The poppet valve member includes a rod which slidably extends through the hollow shuttle and which rigidly interconnects a poppet head engageable with the seat and a flange. The shuttle is positioned between the head and the flange. The shuttle engages the flange as it moves to its regeneration position to unseat the poppet valve member and permit fluid flow through the extension passage to the extension chamber during extension of the cylinder.

DETAILED DESCRIPTION

Figure 1:
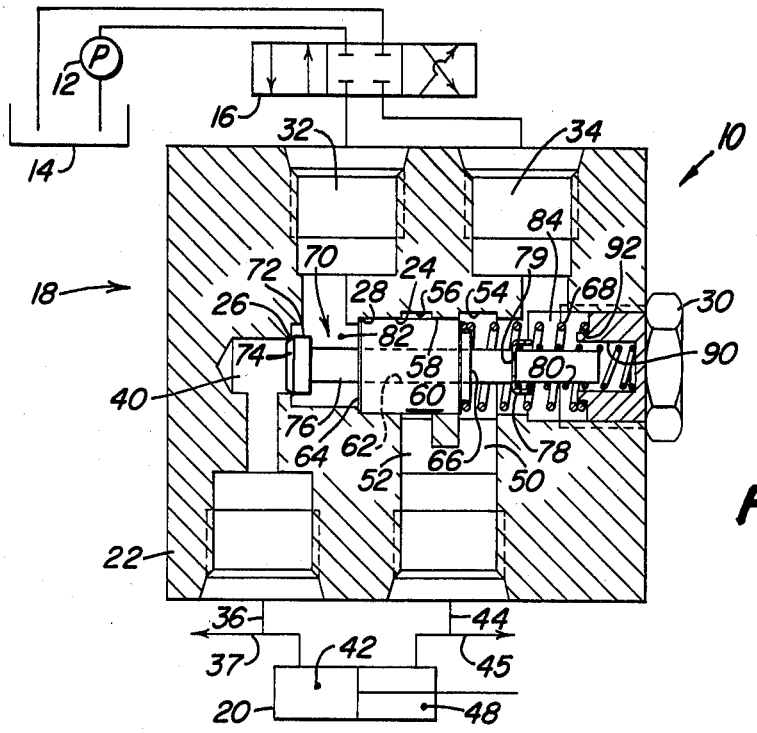
FIG. 1 is a partial sectional view of a speed-up valve constructed according to applicants' invention and shown in a neutral operating position.

A hydraulic system 10 includes a pump 12 and reservoir 14 connected to a conventional 4-way, 3-position directional control valve 16. A regenerative or speed-up valve 18 is coupled between the directional control valve 16 and a 2-way hydraulic cylinder or fluid motor 20.

Speed-up valve 18 includes a housing 22 which defines a stepped valve bore 24 extending therein. The wall of stepped bore 24 defines a poppet seat at 26 and an annular axially facing shoulder at 28. A threaded end cap 30 is screwed into the end of bore 24 to fluidly seal bore 24 from the exterior environment. First and second control passages 32 and 34 intersect the valve bore 24 near opposite ends of bore 24 and communicate the valve bore 24 with the respective outlets of the directional control valve 16. A first work passage 36 communicates with the head end chamber 42 of the fluid motor 20 and includes a portion 40 which intersects valve bore 24 at shoulder 26. A second work passage 44 is communicated with the rod end 48 of fluid motor 20 and includes branches 50 and 52 which communicate with the valve bore 24 at annular grooves 54 and 56, respectively. A land 58 separates grooves 54 and 56.

A hollow cylindrical valve member or shuttle 60 is slidably and movably mounted in the valve bore 24. A central axial bore 62 extends through shuttle 60. Shuttle 60 includes an axially facing annular end face 64 which has an outer edge engageable with shoulder 28. The opposite end of shuttle 60 includes an axially raised central portion 66 received by a spring or resilient member 68 which is coupled between stopper 30 and shuttle 60 and which urges end face 64 towards engagement with shoulder 28.

A poppet member 70 includes a head 72 with a frustoconical sealing surface 74 which is sealingly engageable with the poppet seat 26. The head 72 is coaxially fixed to an end of a cylindrical rod 76 which extends axially away from the head 72 and extends through the central bore 62 in shuttle 60. A cylindrical flange 78 with a notch 79 is mounted or fixed in a reduced diameter portion of rod 76 so that the shuttle 60 is interposed between the head 72 and the flange 78 of poppet member 70. The outer portions of flange 78 are turned axially away from shuttle 60 so that the flange 78 may receive one end of a spring or resilient member 80. The other end of spring 80 engages stopper 30 so that spring 80 urges head 72 toward sealing engagement with poppet seat 26. Note that both springs 68 and 80 are biased to urge the shuttle and poppet members 60 and 72, respectively, to the left, viewing the figures. The threaded end cap 30 includes a blind bore 90 extending therein for receiving an end of the poppet rod 76 and for receiving an end of spring 80. A raised annular ridge 92 surrounds the open end of bore 90 and is received by spring 68.

The shuttle 60 and the poppet member 70 cooperate with the wall of bore 24 to define first and second valve chambers 82 and 84. First valve chamber 82 communicates with control passage 32 and work passage 40. Valve chamber 84 communicates with control passage 34 and with work passage 44 via branch passage 50 and groove 54. Note that no matter what position the shuttle 60 or poppet member 70 are in, the valve chambers 82 and 84 are never in fluid communication with each other. This is because only one, but not both, of the grooves 54 and 56 may be opened to the bore 24 by the shuttle 60 at any one time.

It should be noted that service passages 36 and 44 may be branch connected to serve additional fluid motors (not shown) via branch lines 37 and 45. The branch connections may, of course, be made interior or exterior to the housing 22 of bypass valve 18.

MODE OF OPERATION

With directional control valve 16 in a neutral (no-flow) position, the speed-up valve 18 will be in the position shown in FIG. 1. In this position, spring 68 maintains shuttle 60 in contact with shoulder 28 so that fluid communication is open between control passage 34 and work passage 44 and so that fluid communication is closed between work passage 44 and control passage 32 and closed between work passage 44 and work passage 36. Also, spring 80 lightly maintains poppet head 72 in engagement with poppet seat 26.

Now, if it is desired to retract the fluid motor 20, the directional control valve 16 is operated to connect control passage 34 to pump or supply pressure and to connect control passage 32 to sump or reservoir pressure. The relatively high pressure in passage 34, as compared to passage 32, maintains shuttle 60 seated against shoulder 28 so that fluid flows from passage 34, through valve bore 24, branch passage 50, work passage 44 to rod end chamber 48. This retracts fluid motor 20 and causes the piston 21 of fluid motor 20 to move to the left, viewing FIG. 1, thus forcing fluid out of head chamber 42. The fluid exiting from head chamber 42 flows through work passage 40 and portion 36 and moves poppet head 72 away from poppet seat 26 and against the bias of spring 80 and the fluid pressure in chamber 84 so that the fluid from head chamber 42 may exit to sump via valve bore 24, control passage 32 and directional control valve 16.

Figure 2:
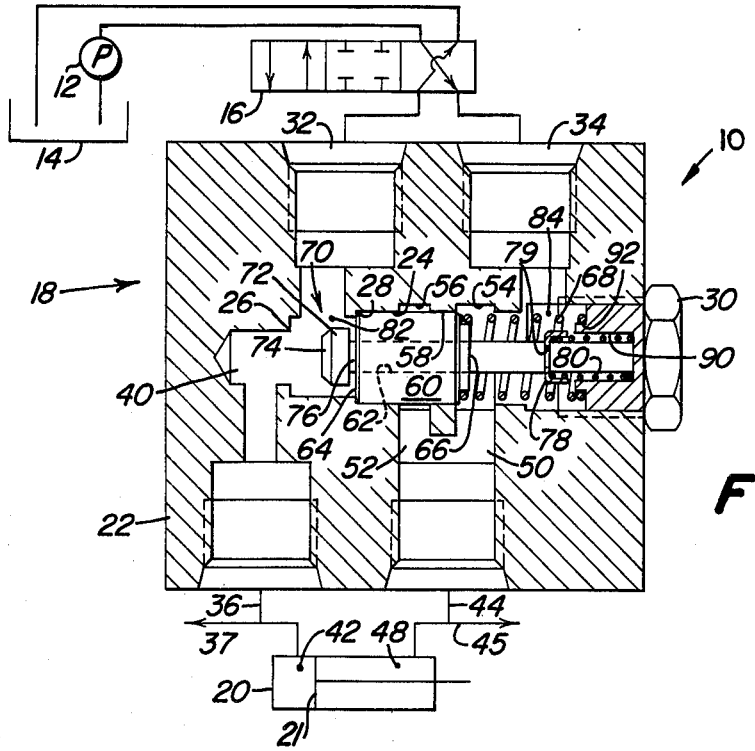
FIGS. 2 and 3 are views similar to that of FIG. 1, but showing the applicants' speed-up valve in cylinder-retracting and cylinder-extending operating positions, respectively.
Figure 3:
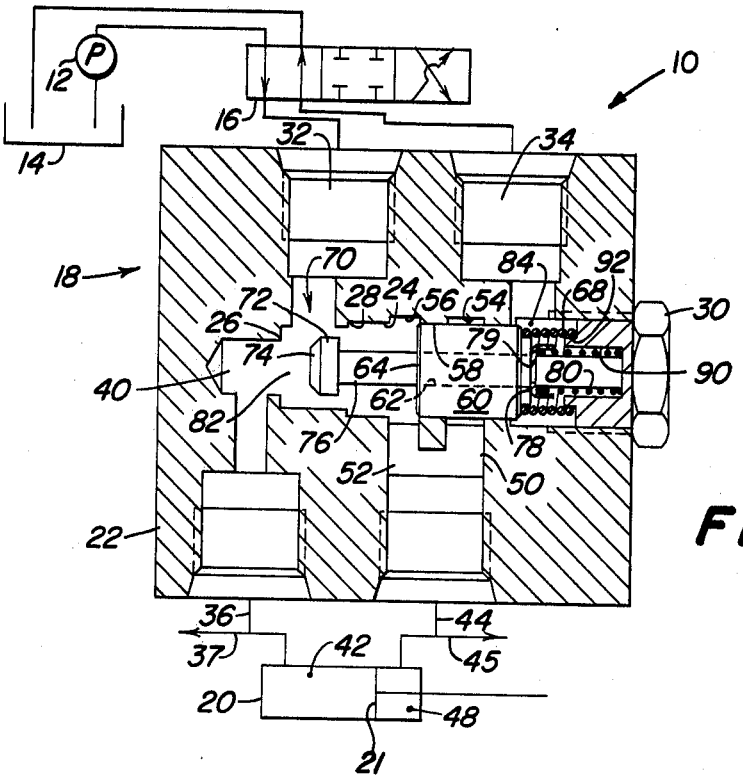

Now, if it is desired to shift from the neutral mode (shown in FIG. 1) to the extend or dump mode (shown in FIG. 3) to extend the fluid motor 20, the directional control valve 16 is operated to connect control passage 32 to pump pressure and to connect control passage 34 to sump or reservoir pressure. A heavy load acing to extend the cylinder will cause a pressure buildup in the rod chamber 48 which will act in valve chamber 84 to resist the motion of shuttle 60 to the right. However, as fluid enters valve chamber 82 from control passage 32, the poppet head 72 is seated against seat 26, thus preventing fluid from exiting from chamber 82. This causes a pressure buildup in valve chamber 82. Because valve chamber 84 is vented to sump 14 via control passage 34 and directional control valve 16, the pressure in valve chamber 82 will rapidly exceed the pressure in valve chamber 84. The resulting pressure differential between the end faces 64 and 66 of shuttle 60 moves the shuttle 60 in the bore 24 and with respect to the poppet member 70, to the right from its seated position shown in FIGS. 1 and 2. While poppet member 70 remains seated against seat 26, shuttle 60 first moves across groove 54 and blocks branch passage 50 while branch passage 52 remains blocked, thus closing communication between service passage 44 and control passage 34, thus momentarily preventing the escape of fluid from rod end chamber 48. At this point, valve chamber 84 is now connected only to sump via control passage 34, thus further increasing the pressure differential between valve chambers 82 and 84. As the shuttle 60 continues to move to the right, it next engages the flange 78 and pulls poppet head 72 away from poppet seat 26. Finally, shuttle 60 uncovers groove 56 and opens communication between rod end chamber 48 and head end chamber 42 via a regeneration passage which includes portions of service passage 44, branch passage 52, the bore 24, valve chamber 82 and passages 40 and 36. Further motion of the shuttle 60 and poppet member 70 is prevented when the end of rod 76 engages the bottom of bore 90 of end cap 39. At this point, the shuttle 60 and poppet 70 are in a regeneration position, thus opening the head end chamber 42 to fluid from the pump 12 via control passage 32, valve chamber 82 and passages 40 and 36 and to fluid from the rod end chamber 48 via the regeneration passage. Thus, as the piston of fluid motor 20 moves to the right, fluid from the rod end chamber 48 is diverted or regenerated back to the head and chamber. This extra diverted flow to head end chamber 42 compensates for the fact that head end chamber 42 has a larger volume than chamber 48 and thus reduces the amount of fluid which must otherwise be supplied to head end chamber 42 from the pump 12 during extension of fluid motor 20. This permits a rapid extension of fluid motor 20.

We claim:

1. In a fluid system having a fluid pressure source, a sump, a directional control valve coupled to the source and the sump, a cylinder having head and rod chambers, and a regenerative valve coupled between the directional control valve and the cylinder, the regenerative valve comprising:

a housing;

a valve bore in the housing;

first and second control passages, each having one end intersecting the valve bore and another end for communicating with the directional control valve;

a first work passage communicating the bore with the head chamber;

a second work passage communicating the bore with the rod chamber;

a poppet seat defined by a portion of the housing separating the valve bore and the first work passage;

a poppet member movable in the valve bore between a closed position wherein the poppet member engages the poppet seat to prevent fluid communication between the first control passage and the first work passage and an open position wherein the poppet member is spaced apart from the poppet seat to permit fluid communication between the first control and first work passages;

a first resilient member biased to urge the poppet member towards the poppet seat;

a valve member movable in the valve bore between a working position wherein the valve member cooperates with the wall of the bore to permit fluid communication between the second control and second work passages and to prevent fluid communication between the second work passage and the first control and first work passages, and a regenerative position wherein the valve cooperates with the wall of the bore to prevent fluid communication between the second control and second work passages and to permit fluid communication between the second work passages and the first work passage, one of the poppet and valve members slidably and coaxially receiving a portion of the other of the poppet and valve members, the valve member including an abutment engageable with a corresponding stop on the poppet member to pull the poppet member away from the poppet seat as the valve member moves from the working to the regenerative positions; and a second resilient member biased to urge the valve member to the working position.

2. The regenerative valve of claim 1, wherein:

the valve member comprises a cylindrical body with a central axial bore extending therethrough, an annular end face of the body comprising the valve member abutment; and the poppet member comprising a rod extending through and slidably received by the central axial bore in the cylindrical valve member body, a head fixed to one end of the rod and sealingly engageable with the poppet seat, and a flange fixed to the rod and engageable with the annular end face, the cylindrical body being interposed between the poppet head and the poppet flange.

3. The regenerative valve of claim 2, wherein:

the first resilient member includes one end engaging the housing and a second end engaging the flange.

4. The regenerative valve of claim 2, wherein:

the second resilient member includes one end engaging the housing and a second end engaging the annular end face of the valve member cylindrical body.

5. A regenerative valve comprising:

a housing;

a walled valve bore in the housing;

a shuttle member movable in the bore and cooperating with the wall of the bore to separate the valve bore into first and second valve chambers therein;

first and second control passages communicated with the first and second valve chambers, respectively;

a first work passage communicated with the first valve chamber and for communicating the first valve chamber with a head end chamber of a double-acting hydraulic cylinder;

a second work passage communicated with the second valve chamber and for communicating the second valve chamber with a rod end chamber of the double-acting hydraulic cylinder;

a regenerative passage communicated with the first valve chamber and for communicating the first valve chamber with the rod end chamber;

the shuttle member being movable in response to a differential fluid pressure between the first and second valve chambers from a normal position wherein fluid communication is blocked between the regenerative passage and both first and second valve chambers and wherein the second work passage is communicated with the second valve chamber to a regenerative position wherein the regenerative passage is communicated with the first valve chamber and wherein communication is blocked between the second work passage and the second valve chamber;

a poppet member movable in the bore and engageable with a seat formed by the wall of the bore to prevent fluid flow from the first valve chamber into the first work passage, the shuttle member and the poppet member each including abutments engageable with the other as the shuttle member moves to its regenerative position to thereby pull the poppet member away from the seat to open communication between the first valve chamber and the first work passage;

a first resilient member biased to urge the poppet member toward the seat; and a second resilient member biased to urge the shuttle member towards its normal position.

6. The regenerative valve of claim 5, wherein:

one of the shuttle and poppet members includes a stem portion coaxially and slidably received by a corresponding bore in the other of the shuttle and poppet members.

7. The regenerative valve of claim 5, wherein:

the shuttle member comprises a cylindrical body with a bore extending axially therethrough, an annular end face of the body comprising the shuttle member abutment; and the poppet member comprising a head sealingly engageable with the seat, a flange having a surface comprising the shuttle member abutment, and a rod rigidly interconnecting the head and the flange and slidably received by the bore in the shuttle body, the shuttle member being positioned between the head and the flange of the poppet member.

8. The regenerative valve of claim 5, wherein:

the shuttle member moves away from the seat when it moves from its normal to its regenerative positions.

9. The regenerative valve of claim 7, wherein:

the flange and a portion of the rod cooperate to define an annular socket therebetween for receiving an end of the first resilient member.

10. The regenerative valve of claim 5, further comprising:

a first shoulder engageable with the shuttle member when the shuttle member is in its normal position.

11. In a hydraulic system having a fluid reservoir, a source of pressurized fluid, and a cylinder having a retraction chamber and having an extension chamber for receiving fluid from the source during extension of the cylinder, a regenerative valve comprising:

a housing defining a bore therein;

an extension passage in the housing interconnecting the source and the extension chamber;

a retraction passage in the housing for interconnecting the reservoir and the retraction chamber;

a regenerative passage in the housing for interconnecting the retraction chamber and the extension chamber;

a valve member in the extension passage movable to permit or block fluid flow from the source to the extension chamber; and a shuttle member movable in the housing bore from a normal position blocking the regenerative passage and opening the retraction passage to a regenerative position blocking the retraction passage and opening the regenerative passage, the shuttle and valve members having abutments engageable with each other to move the valve member to a position permitting flow from the source to the extension chamber as the shuttle member moves to its regenerative position.

12. A fluid valve comprising:

a valve housing;

a valve bore formed in the housing;

first and second control passages formed in said housing in communication with said bore at spaced locations;

first and second work passages formed in said housing in communication with said bore at spaced locations;

a first valving member movable in said bore between a closed position preventing fluid flow from said first control passage to said first work passage and an open position permitting fluid flow from said first control passage to said first work passage;

a second valving member movable in the bore and with respect to the first valving member between a first position in which it prevents communication between the second working passage and the first control passages while permitting communication between the second control and second working passages and a second position in which it prevents communication between the second working and second control passages while permitting communication between the second working and first control passages; and first and second resilient means positioned in the valve bore and biasing the first and second valving members toward the closed and first positions, respectively.

13. The valve as set forth in claim 12 wherein:

the second valving member is slidable in the valve bore and has first and second end faces responsive to fluid pressure in the first and second control passages, respectively, to move the second valving member toward the second position against the bias of the second resilient means when the fluid pressure in the first control passage is greater than the fluid pressure in the second control passage; and the valve comprising means acting between the first and second valving members to move the first valving member to the open position as the second valving member is moved to the second position.

14. A fluid valve comprising:

a valve housing;

a valve bore formed in the housing;

first and second control passages formed in said housing in communication with said bore at spaced locations;

first and second work passages formed in said housing in communication with said bore at spaced locations;

a first valving member movable in said bore between a closed position preventing fluid flow from said first control passage to said first work passage and an open position permitting fluid flow from said first control passage to said first work passage;

a second valving member movable in the bore between a first position in which it prevents communication between the second working passage and the first control passages while permitting communication between the second control and second working passages and a second position in which it prevents communication between the second working and second control passages while permitting communication between the second working and first control passages; and first and second resilient means positioned in the valve bore and biasing the first and second valving members in the same direction toward the closed and first positions, respectively.

* * * * *